United States Patent [19]

Schütte et al.

[11] Patent Number: 4,651,933

[45] Date of Patent: Mar. 24, 1987

[54] CONE CRUSHER

[75] Inventors: Klaus Schütte, Cologne; Helmut Stöckmann, Wesseling, both of Fed. Rep. of Germany

[73] Assignee: Klöckner-Humboldt-Deutz Aktiengesellschaft, Fed. Rep. of Germany

[21] Appl. No.: 670,606

[22] Filed: Nov. 13, 1984

[30] Foreign Application Priority Data

Nov. 14, 1983 [DE] Fed. Rep. of Germany ..... 3341225

[51] Int. Cl.[4] ..... B02C 2/00

[52] U.S. Cl. ..... 241/34; 241/202; 241/207; 241/284

[58] Field of Search ..... 241/207–216, 241/98, 81, 30, 34, 26, 284, 202, 248

[56] References Cited

U.S. PATENT DOCUMENTS

| | | | |
|---|---|---|---|
| 2,296,281 | 9/1942 | Gruender | 241/202 X |
| 2,509,919 | 5/1950 | Gruender | 241/202 X |
| 3,604,635 | 9/1971 | Gasparac et al. | 241/202 X |
| 3,614,023 | 10/1971 | Archer et al. | 241/202 |
| 3,957,213 | 5/1976 | Stockman et al. | 241/202 |

FOREIGN PATENT DOCUMENTS

| | | | |
|---|---|---|---|
| 727222 | 4/1980 | U.S.S.R. | 241/202 |

*Primary Examiner*—Mark Rosenbaum

*Attorney, Agent, or Firm*—Hill, Van Santen, Steadman & Simpson

[57] ABSTRACT

A cone crusher is provided for fine and superfine comminution and a high throughput performance. The largest open gap clearance between the crushing mantle and the crushing cone in the region of the crushing zone is not smaller than the grain size of the feed product to be comminuted as heretofore known, but larger than such grain size. A so-called stratified crushing occurs under the filling pressure of a relatively high column of feed product, wherein the grains of the feed product are not individually crushed per se between the crushing tools, but largely mutually crush one another in the crushing gap.

4 Claims, 3 Drawing Figures

SUPPLY AND FEED
CLASSIFIER
FEED METER

LEVEL DETECT
17b
16
17a
γ
28
27
15
13
10
18
11
19
20
12
14
PH
PV
PR
FINE OR SUPERFINE PRODUCT OUT
OVERSIZE PRODUCT
CLASSIFIER

CONE CRUSHER

BACKGROUND OF THE INVENTION

1. Field of the Invention

The present invention relates to a cone crusher comprising an annular crushing chamber between an outer, stationary annular crushing metal and an inner gyral-tumbling crushing cone.

2. Description of the Prior Art

In cone crushers, the communution occurs in an annular crushing chamber between a gyral-tumbling crushing cone and a stationary, annular crushing mantle. Cone crushers have theretofore been operated such that the delivery grain size of the product to be comminuted is always greater than the crushing gap width between the crushing mantle and the crushing cone, so that practically each individual grain of the feed is individually crushed or, respectively, shattered between the crushing tools. Feeding the cone crusher with a product whose grain size is smaller than the crushing gap width has heretofore been avoided in order not to run the risk that such product emerges through the crushing gap uncomminuted. Given a desired fine comminution and, above all, a superfine comminution, the known operating mode requires very narrow and uniform crushing gaps which can only be maintained as a consequence of wear by frequent retooling or replacement of the crushing tools. Further, the throughput performance of cone crushers operated with such a narrow crushing gap is low in comparison to the size of the crusher and a relatively high specific energy consumption results. The loads are thereby disproportionally high.

SUMMARY OF THE INVENTION

The object of the present invention is to provide a cone crusher for fine and superfine comminution without having to operate the cone crusher with an extremely small crushing gap and the relatively low throughput performance and extreme loading with result therefrom.

The above object is achieved, according to the present invention, in a cone crusher which is characterized in that the gap width between the crushing mantle and the crushing cone tapers and is greater in the region of its crushing zone than the grain size of the feed product to be comminuted. Because, given the cone crusher of the present invention, the maximum feed product grain size is smaller than the greatest opening gap width between the crushing mantle and the crushing cone in the region of the crushing zone thereof, and individual grain comminution wherein, so to speak, the crushing is not carried out grain-by-grain between the crushing tools, but rather a stratified crushing occurs from the very outset wherein the particles of the feed product mutually crush one another on a fill or, respectively, in a grain collective or product bed. So that the individual grains of the feed product cannot emerge through the open crushing gap of the cone crusher in an uncomminuted state, the angle of the crushing cone in the region of the crushing zone roughly corresponds to the angle of incline of the feed product according to a further feature of the invention. The feed product is pressed into the relatively large crushing gap via a relatively high material column in order to achieve a high filling pressure. To that end, a feed product hopper or feed product shaft, according to a feature of the invention, is disposed above the crushing mantle and the crushing cone, the hopper or shaft being fully filled with a nearly resting feed product fill which is supported directly against the crushing cone at the bottom of such fill. The circularly tumbling crushing cone automatically draws the feed product into the crushing gap by way of friction, drawing it into the gap from the feed product hopper. A high throughput performance is achieved due to a relatively large gap clearance, namely larger than the grain size of the feed product to be comminuted, this leading to a reduction of the specific energy requirement (kWh/t of material) of a cone crusher constructed in accordance with the present invention whereby a high proportion of fine superfine grains of the comminuted product is achieved despite the relatively large gap clearance. As a result of stratified crushing, the cone crusher of the present invention is therefore in the position of producing large quantities of fine grain given a relatively low specific energy consumption. Flat and oblong particles are also broken into a predominantly squat and cubic shape by way of this operating mode.

Expressed in other words, this means that fine and superfine grain that previously known superfine cone crushers could only produce with a very narrow, closed crushing gap width of, for example, 4 mm and with a very flat crushing cone can be produced by practicing the present invention with a cone crusher having a far larger, closed crushing gap width of, for example, 8 mm and a steeper crushing cone.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

A further advantage of the cone crusher of the present invention is that it is insensitive to damp material and can comminute material having, for example, 2%–15% moisture, whereas flat cone crushers heretofore employed for superfine comminution become blocked given a material dampness greater than 1%–2% as a consequence of briquetting of the material and can therefore no longer comminute pitwet material, for example gravel having 4%–6% moisture.

Figure 1:
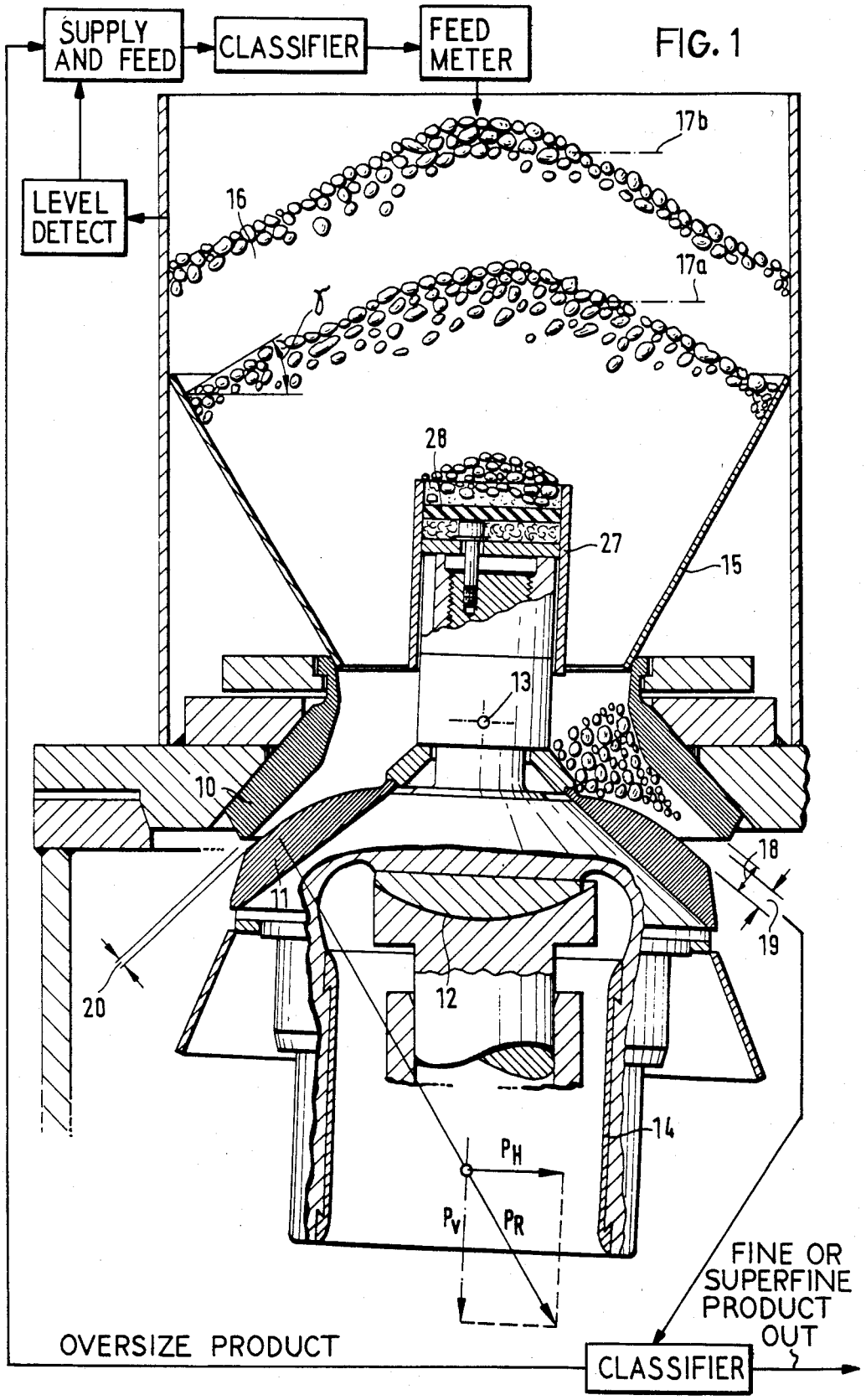
FIG. 1 is a vertical section through the upper portion of a cone crusher constructed in accordance with the present invention.

Referring to FIG. 1, a cone crusher is illustrated as comprising an annular crushing chamber between an outer, stationary annular crushing cone mantle 10 and an inner, circularly tumbling crushing cone 11 which is supported via a bearing cone and a spherical axial bearing 12 so that the crushing cone 11 can execute a circular tumbling motion around a pivot point 13. The radial forces are absorbed by a radial bearing 14. A feed product hopper 15 is filled full with a nearly resting feed product 16. The feed product is supported directly on the crushing cone 11 and is disposed above the crushing mantle 10 and the crushing cone 11. The level of the product fill is maintained between a minimum filling level 17*a* and a maximum filling level 17*b* via a filling level metering and control device, whereby the distance between the two filling levels can amount to, for example, about 300 mm as a controlled system. The column of crusher product supported on its bottom on the crushing cone 11 is relatively high for a cone crusher and can amount to about 1000 mm in the embodiment illustrated.

Figure 2:
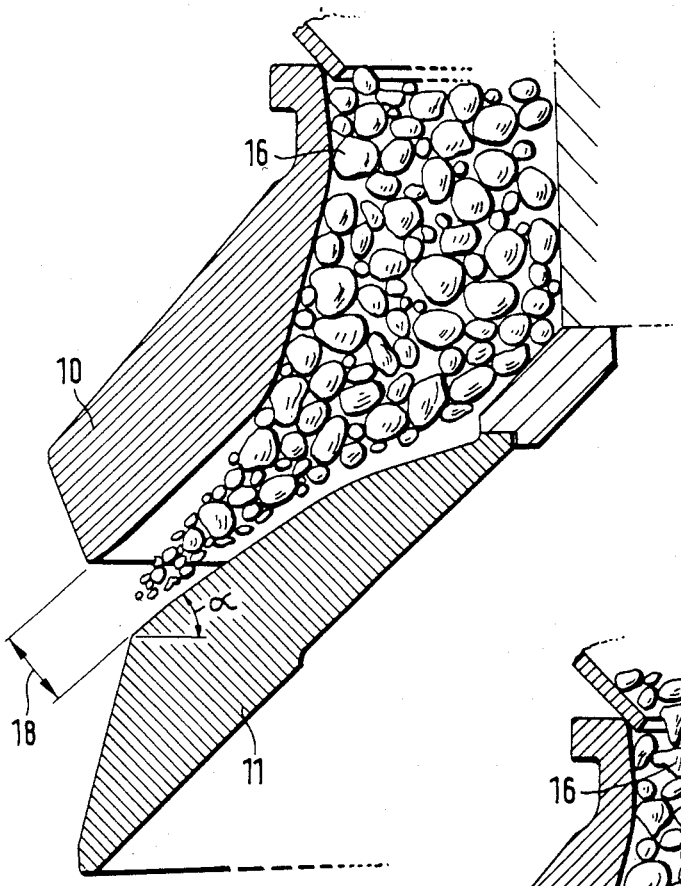
FIG. 2 is a fragmentary enlarged sectional view of the crushing tools of the cone crusher of FIG. 1 having an open crushing gap.

Characteristic of the cone crusher of the present invention is that the largest open gap clearance 18 between the crushing mantle 10 and the crushing cone 11 in the region of its crushing zone is larger than the grain size of the feed product to be comminuted, so that the beneficial, stratified crushing described above can be executed. The largest open gap clearance 18 between the crushing mantle 10 and the crushing cone 11, also clearly illustrated in FIG. 2, amounts to about 48 mm in the illustrative embodiment and the maximum grain size of the feed product 16 is less and amounts, for example, to 16 mm or 25 mm. This is maintained in that a grader or classifier is upstream in the feed system to the cone crusher, the cut-off grain size of the grader being set such that the grain size of the feed product 16 for the cone crusher is smaller than the largest open gap clearance 18 in the crushing zone of the cone crusher. The stroke 19 of the crushing cone amounts, for example, to 40 mm and is shown on the right-hand side of FIG. 1, whereas the closed crushing gap of, for example, 8 mm is indicated on the left-hand side of FIG. 1, as well as in FIG. 3.

The comparatively high and quasi-resting material column in the feed product hopper 15 produces the high fill pressure in the crushing gap required for stratified crushing or, respectively, product bed crushing. The circularly tumbling crushing cone 11 automatically draws the feed product 16 out of the feed hopper 15 into the crushing gap by friction. According to a special feature of the invention, the crushing cone angle $\alpha$ in the region of the crushing zone roughly corresponds to the angle of incline $\gamma$ of the feed product 16 so that individual grains of the feed product do not slip through the relatively large crushing gap and, on the other hand, so that the material product column does not back up too greatly in its lower region. Given an angle of incline $\gamma$ of the feed product which amounts, for example, to 33° (FIG. 1) the crushing cone angle $\alpha$ (FIGS. 2 and 3) is then set, for example, to 30°–45°.

Figure 3:
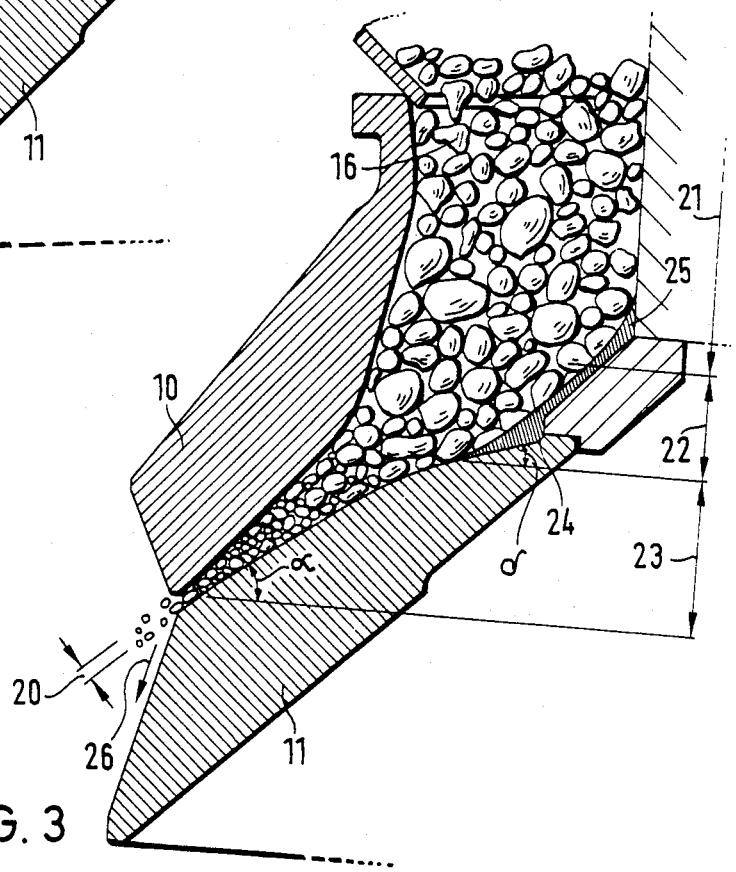
FIG. 3 illustrates the same elements of FIG. 2 with a closed crushing gap.

It may also been seen in FIG. 3 that the feed product fill 16 or the feed product material column, is divided as seen from top to bottom into a filling zone 21, an admission zone 22 and a crushing zone 23. In the transition region between the emission zone 22 and the crushing zone 23, the crushing cone angle, upon formation of an annular depression 24, is smaller than the angle of incline $\gamma$ of the feed product 16. During operation of the cone crusher of the invention, the annular depression 14 is filled with compressed superfine product 25 of the feed product 16, whereby this stratum of superfine product acts as an anti-wear means for the crushing cone. As may be seen in FIG. 1, the crushing cone angle in the crushing zone 23 may steadily increase from the transition region having the angle $\delta$ to the final region having the angle $\alpha$, so that a spherically-crowned contour of the crushing cone 11 derives in the crushing zone, the stratified crushing or, respectively, the product bed crushing as well as the wear behavior and the exploitation of the crushing tool therefore being promoted. A high proportion of the final grain 26 (FIG. 3) is smaller than the set gap clearance of 8 mm.

As may also been seen from FIG. 1, the upper side of the axle of the crushing cone comprises a peg 27 projecting from bottom to top and to the feed product hopper 15, the peg being covered at its upper side by a rubber plate 28 or the like and, given its circular, tumbling motion, agitates the feed product 16 out of the filling zone 21 of the feed product fill into the admission zone 22 and the crushing zone 23, so that the material product column always remains tightly packed without interstices. The cone crusher is advantageously followed downstream by a grader or classifier whose course fraction is returned in circulation to the feed product hopper of the cone crusher. As also is seen in FIG. 1, the crushing tools are disposed such that the resultant $P_R$ of the crushing force proceeding at right angles relative to the surface of the crushing cone 11 impinges the access of the crushing cone within its radial bearing 14 in an advantageous manner. The component of the crushing force acting horizontally relative to the crushing cone is referenced $P_H$ in FIG. 1 and the component of the crushing force acting vertically relative to the crushing cone is referenced $P_V$.

Although we have described our invention by reference to particular illustrative embodiments thereof, many changes and modifications may become apparent to those skilled in the art without departing from the spirit and scope of the invention. I therefore intend to include within the patent warranted hereon all such changes and modifications as may reasonably and properly be included within the scope of my contribution to the art.

We claim:

1. A cone crusher for comminuting feed product grains of a predetermined size, comprising:

a crushing mantle;

a crushing cone mounted for circular tumbling adjacent said crushing mantle and therewith defining a gap whose largest clearance is greater than the feed product grains to be comminuted;

feed means for supplying the grains of predetermined size, including a feed hopper mounted above said crushing mantle and said crushing cone for holding the feed product grains to be comminuted so that they are supported in a column on said crushing cone and drawn into said gap by the action of said crushing cone for mutually crushing one another;

said feed means further including means for piling up said column of grains to provide an upper end which is higher than the periphery of the column and defines an upper column periphery at an angle $\gamma$ with respect to horizontal;

said crushing cone comprising a cone angle $\alpha$ at its periphery which is approximately equal to the angle $\gamma$;

said crushing cone comprising an annular depression in said admission zone for collecting a compressed superfine product which acts as an anti-wear element;

said crushing cone comprising a spherically-crowned surface contour defined by an angle which increases from an angle $\delta$ at said annular depression to said angle $\alpha$ at its periphery;

a peg extending from said crushing cone into said feed hopper for agitating the feed product grains; and said feed means comprising a grain classifier for obtaining the predetermined size of grain.

2. The cone crusher of claim 1, wherein:

said feed hopper and said gap define a filling zone, an admission zone into said gap and a crushing zone.

3. The cone crusher of claim 1, wherein:

said feed means comprises a grain classifier for receiving the comminuted product and returning a coarse fraction to said feed hopper for further comminution.

4. The cone crusher of claim 1, wherein:

said feed means comprises a fill level detector and a feed metering device controlled by said fill level detector to maintain the column height between first and second predetermined levels.

* * * * *